US007196680B2

(12) United States Patent
Park

(10) Patent No.: US 7,196,680 B2
(45) Date of Patent: Mar. 27, 2007

(54) DRIVE APPARATUS AND METHOD FOR PLASMA DISPLAY PANEL

(75) Inventor: Jung-Pil Park, Cheonan (KR)

(73) Assignee: Samsung SDI Co., Ltd. (KR)

( * ) Notice: Subject to any disclaimer, the term of this patent is extended or adjusted under 35 U.S.C. 154(b) by 387 days.

(21) Appl. No.: 10/438,177

(22) Filed: May 14, 2003

(65) Prior Publication Data

US 2004/0090395 A1 May 13, 2004

(30) Foreign Application Priority Data

Nov. 11, 2002 (KR) ..... 10-2002-0069642

(51) Int. Cl.
*G09G 3/28* (2006.01)
*G09G 3/10* (2006.01)

(52) U.S. Cl. ..... 345/63; 345/67; 345/210; 345/204; 315/169.4

(58) Field of Classification Search ..... 345/60–67, 345/204, 208–210; 315/169.3, 169.4; 348/797; 313/484, 586
See application file for complete search history.

(56) References Cited

U.S. PATENT DOCUMENTS 5,745,086 A 4/1998 Weber
5,835,072 A * 11/1998 Kanazawa ..... 345/60
6,249,087 B1 * 6/2001 Takayama et al. ..... 315/169.1
6,483,251 B2 * 11/2002 Setoguchi et al. ..... 315/169.4
6,653,994 B2 * 11/2003 Takeda et al. ..... 345/60
6,738,033 B1 * 5/2004 Hibino et al. ..... 345/60
6,768,478 B1 * 7/2004 Wani et al. ..... 345/60
6,784,859 B2 * 8/2004 Setoguchi et al. ..... 345/60

(Continued)

FOREIGN PATENT DOCUMENTS

EP 1 195 739 A2 4/2002
KR 10-0388912 12/2002

OTHER PUBLICATIONS

European Search Report dated Dec. 28, 2004.

(Continued)

*Primary Examiner*—Lun-Yi Lao
(74) *Attorney, Agent, or Firm*—Christie, Parker & Hale, LLP

(57) ABSTRACT

The present invention provides a drive apparatus and method for a plasma display panel, in which the drive apparatus and method improve contrast and prevent misdischarge. According to the drive method, in a reset interval of a first sub-field, a voltage having an increasing ramp waveform is applied to scan electrodes during a first interval, and common electrodes are floated during a portion of the first interval such that a voltage of the common electrodes is increased to an initial voltage, which corresponds to a voltage applied to the scan electrodes and to a voltage applied to both sides of panel capacitors. Further, in a reset interval of a second sub-field, which exhibits a higher gray than the first sub-field, a voltage having an increasing ramp waveform is applied to the scan electrodes during a second interval, and floating the common electrodes during a portion of the second interval such that the voltage of the common electrodes is increased to another voltage, which is less than the initial voltage.

13 Claims, 5 Drawing Sheets

U.S. PATENT DOCUMENTS

| | | | | |
|---|---|---|---|---|
| 6,809,708 | B2 * | 10/2004 | Kanazawa et al. | 345/68 |
| 6,816,136 | B2 * | 11/2004 | Tanaka et al. | 345/66 |
| 6,836,262 | B2 * | 12/2004 | Hashimoto et al. | 345/60 |
| 6,844,685 | B2 * | 1/2005 | Lee | 315/169.3 |
| 6,906,690 | B2 * | 6/2005 | Lim | 345/60 |
| 6,956,331 | B2 * | 10/2005 | Lee et al. | 315/169.1 |
| 7,012,579 | B2 * | 3/2006 | Choi | 345/60 |
| 2002/0080097 | A1 | 6/2002 | Tokunaga et al. | |
| 2002/0118149 | A1 | 8/2002 | Tanaka et al. | |
| 2003/0107532 | A1 | 6/2003 | Choi | |

OTHER PUBLICATIONS

Gun-Su Kim, et al., *P-60: Reset Waveform for Dark-Room Contrast-Ratio Improvement*, SID 03 Digest, May 20, 2003, XP-001171735, pp. 446-449.

Korean Patent Abstracts for Korean Patent No. 10-00388912, published Dec. 12, 2002, in the name of Jun Gu Kim et al.

European Search Report dated Jun. 30, 2005 for Application No. 03090162, in the name of Samsung SDI Co., Ltd.

* cited by examiner

DRIVE APPARATUS AND METHOD FOR PLASMA DISPLAY PANEL

CROSS-REFERENCE TO RELATED APPLICATION

This application claims priority of Korean Patent Application Number 2002-0069642, filed on Nov. 11, 2002.

BACKGROUND OF THE INVENTION (a) Field of the Invention

The present invention relates to a drive apparatus and method for a plasma display panel. More particularly, the present invention relates to a drive apparatus and method for a plasma display panel in which the drive apparatus and method improve contrast and prevent mis-discharge.

(b) Description of the Related Art

Flat display devices such as the liquid crystal display (LCD), the field emission display (FED), and the plasma display panel (PDP) have recently been undergoing rapid development. The PDP has some advantages over the other flat display configurations, such as in higher brightness, better illumination efficiency, and a wider viewing angle. Accordingly, many anticipate the PDP to replace the cathode ray tube (CRT) for displays having screen sizes of 40 inches or greater.

The PDP is a display device that utilizes plasma generated by gas discharge to realize the display of characters or images. The PDP includes a configuration in which many hundreds to many thousands of pixels (depending on the size of the PDP) are arranged in a matrix. PDPs are classified into the two different types of the DC PDP and AC PDP depending on the drive voltage waveform and discharge cell structure.

In the DC PDP, electrodes are fully exposed in a discharge space such that current flows in the discharge space while voltage is being applied. As a result, resistance for limiting the flow of current must be provided. On the other hand, in the AC PDP, the electrodes are covered with a dielectric layer such that current is limited through the formation of a natural capacitance. As a result, the electrodes are protected from the collision of ions so that the AC PDP has a longer life span.

FIG. 1 is a partial perspective view of an AC PDP.

As shown in the drawing, scan electrodes 4 and sustain electrodes 5 are provided in parallel pairs on a first glass substrate 1, and they are covered by a dielectric layer 2 and a protection film 3. A plurality of address electrodes 8 is provided on a second glass substrate 6, and they are covered with an insulating layer 7. Also, barrier ribs 9 are formed on the insulating layer 7 at areas corresponding to and between the address electrodes 8 and in parallel to the same. Phosphor layers 10 are formed on the insulating layer 7 between the barrier ribs 9. The first glass substrate 1 and the second glass substrate 6 are mounted opposing one another while forming a discharge space 11 therebetween and in such a manner that the scan electrodes 4 and the sustain electrodes 5 are orthogonal to the address electrodes 8. Areas of the discharge space where the address electrodes 8 intersect the pairs of the scan electrodes 4 and sustain electrodes 5 form discharge cells 12.

FIG. 2 schematically shows an electrode arrangement for a plasma display panel.

As shown in the drawing, the PDP electrodes have an m×n matrix configuration. In more detail, the address electrodes (A1–Am) are arranged in the column direction, while n-rows of scan electrodes (Y1–Yn) and sustain electrodes (X1–Xn) are alternately arranged in the row direction. The scan electrodes will hereinafter be referred to as "Y electrodes" and the sustain electrodes will be referred to as "X electrodes". The discharge cell 12 shown in FIG. 2 corresponds to the discharge cell 12 of FIG. 1.

FIG. 3 is a drive waveform of a conventional plasma display panel.

As shown in the drawing, each sub-field is divided into a reset interval, an address interval, and a sustain interval according to the conventional drive method for a PDP. In the reset interval, a wall charge state of a previous sustain discharge is eliminated, and a wall charge is set up to stably perform a subsequent address discharge. The address interval is a period of time during which cells that are on and cells that are off in the panel are selected, and an operation is performed so that wall charges accumulate in cells that are on (cells that are addressed). Further, in the sustain interval, discharge is performed to display an image in the cells that are addressed.

The conventional operations in the reset interval will now be described in more detail. With reference to FIG. 3, the conventional reset interval includes an elimination interval, a Y ramp ascending interval, and a Y ramp descending interval.

(1) Elimination Interval

After a final sustain discharge is completed, a (+) electric charge and a (−) electric charge are accumulated respectively in the X electrodes and the Y electrodes.

Following the completion of the sustain discharge, an elimination ramp voltage that gently increases from 0V to +Ve(V) is applied to the X electrodes. Accordingly, a wall charge formed in the X electrodes and the Y electrodes is gradually eliminated.

(2) Y Ramp Ascending Interval

In the Y ramp ascending interval, the address electrodes and the X electrodes are maintained at 0V, and a ramp voltage gently increasing from voltage Vs to voltage Vset is applied to the Y electrodes. While the ramp voltage is increasing, a first weak reset discharge occurs from the Y electrodes to the address electrodes and to the X electrodes in all discharge cells. As a result, a (−) wall charge is accumulated in the Y electrodes, and a (+) wall charge is accumulated in the address electrodes and the X electrodes.

(3) Y Ramp Descending Interval

In a second half of the reset interval and in a state where the X electrodes are maintained at a constant voltage Ve, a ramp voltage gently decreasing from voltage Vs to 0V is applied to the Y electrodes. While this ramp voltage is decreasing, a second weak reset discharge occurs, again in all the discharge cells.

According to the conventional reset method shown in FIG. 3, the reset discharge occurs in the Y ramp ascending interval and the Y ramp descending interval such that the amount of wall discharge in the cells is adjusted. Accordingly, a precise addressing operation occurs in a subsequent address interval. At this time, the larger the voltage difference between the Y electrodes and the X electrodes, the greater the precision in the addressing operation in the subsequent addressing interval.

However, with the conventional reset method shown in FIG. 3, Vset, which is a high voltage of approximately 380V, is applied to the Y electrodes, while the ground voltage is supplied to the X electrodes. Therefore, an unnecessarily high voltage is applied between the X electrodes and the Y electrodes such that a strong discharge occurs, thereby deteriorating the contrast of the PDP.

SUMMARY OF THE INVENTION

It is one object of the present invention to provide a drive apparatus and method for a plasma display panel, in which the drive apparatus and method prevent unnecessary discharge in a reset interval to improve contrast and that prevent mis-discharge.

In one embodiment, the present invention provides a drive method for a plasma display panel that includes first electrodes, second electrodes, and panel capacitors formed between the first and second electrodes. The method includes during a reset interval (a) applying a voltage having a waveform increasing from one voltage to another voltage to the first electrodes during a first interval; and (b) floating a voltage of the second electrodes during a portion of the first interval thereby increasing the voltage of the second electrodes from one voltage to another voltage responsive to the voltage applied to the first electrodes and to a voltage of both sides of a panel capacitor.

In another aspect, the present invention provides a drive method for a plasma display panel that includes first electrodes, second electrodes, and panel capacitors formed between the first and second electrodes. The method includes (a) applying predetermined voltages to the first and second electrodes so that a first voltage difference develops therebetween, the application of these voltages occurring during a reset interval of a first sub-field; and (b) applying predetermined voltages to the first and second electrodes so that a second voltage difference that is greater than the first voltage difference develops between the first and second electrodes, the application of these voltages occurring during a reset interval of a second sub-field, in which the second sub-field exhibits a higher gray than the first sub-field.

In yet another aspect, the present invention provides a drive method for a plasma display panel that includes scan electrodes, common electrodes, and panel capacitors formed between the first and second electrodes. The method includes, in a reset interval of a first sub-field, (a) applying a voltage having an increasing ramp waveform to the scan electrodes, during a first interval; and (b) floating the common electrodes during a portion of the first interval such that a voltage of the common electrodes increases to another voltage, which corresponds to a voltage applied to the scan electrodes and to a voltage applied to both sides of the panel capacitor; and, in a reset interval of a second sub-field, which exhibits a higher gray than the first sub-field, (c) applying a voltage having an increasing ramp waveform to the scan electrodes, during a second interval; and (d) floating the common electrodes during a portion of the second interval such that the voltage of the common electrodes increases to another voltage, which is a smaller voltage than the other voltage.

The present invention also provides a drive apparatus for a plasma display panel that includes scan electrodes, common electrodes, and panel capacitors provided between the scan electrodes and the common electrodes. The apparatus includes a first transistor coupled to the scan electrode and applying a voltage of an increasing ramp waveform to the scan electrode during a first interval; a second transistor coupled to the scan electrode and applying a voltage of a decreasing ramp waveform to the scan electrode during a second interval; and a third transistor coupled between the common electrode and a voltage. The third transistor floats the common electrode during a portion of the first interval such that a voltage of the common electrode is increased from one voltage to another voltage responsive to the voltage applied to the scan electrode and a voltage to both sides of the panel capacitor.

In another aspect, the present invention provides a drive apparatus for a plasma display panel that includes scan electrodes, common electrodes, and panel capacitors provided between the scan electrodes and the common electrodes, the driving field of the plasma display being divided into a plurality of sub-fields. The apparatus includes a first transistor coupled to the scan electrode and to apply a voltage thereto of a ramp waveform that increases form one voltage to another voltage, the voltage being applied during a reset interval of a first sub-field; a second transistor coupled to the scan electrode and applying a voltage thereto of a ramp waveform that increases from one voltage to another voltage, which is greater than the other voltage, the voltage being applied during a reset interval of a second sub-field, which exhibits a higher gray than the first sub-field; and a third transistor coupled to the scan electrode and applying a voltage thereto of a decreasing ramp waveform.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Preferred embodiments of the present invention will now be described in detail with reference to the accompanying drawings.

Figure 1:
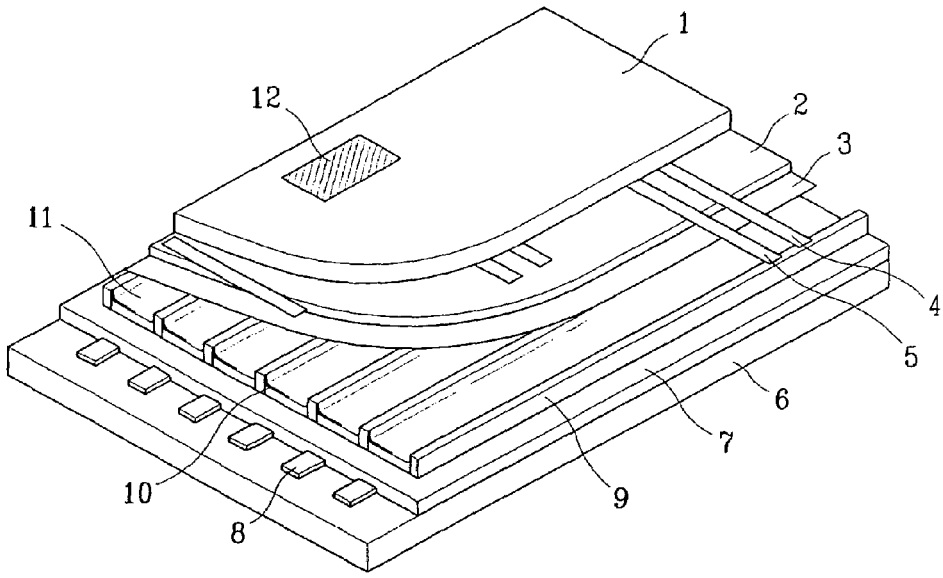
FIG. 1 is a partial perspective view of an AC plasma display panel.
Figure 2:
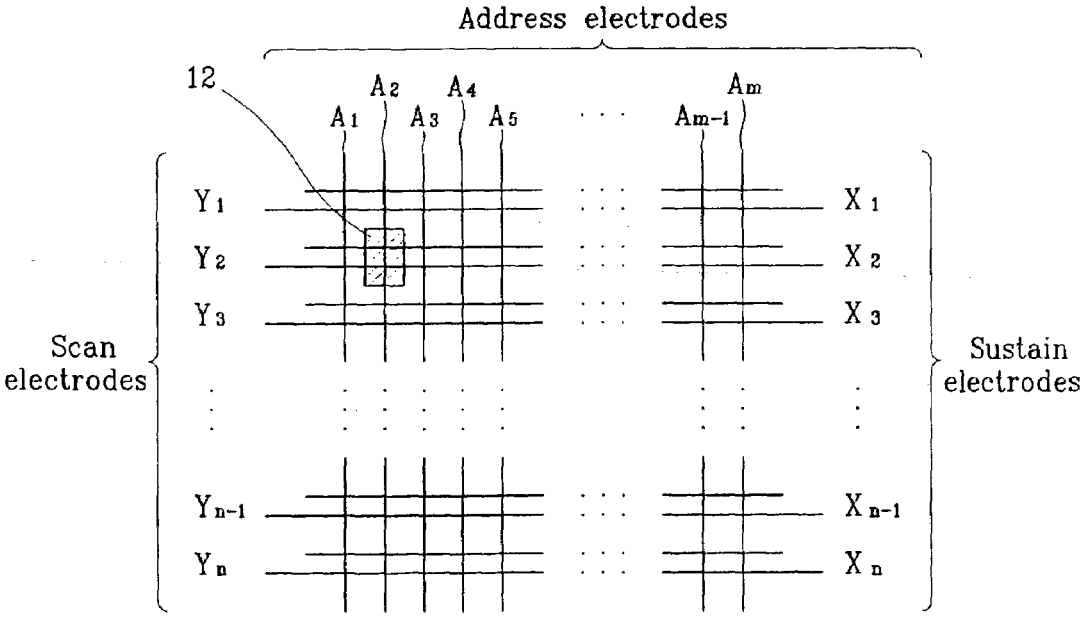
FIG. 2 is a schematic view of an electrode arrangement for a plasma display panel.
Figure 3:
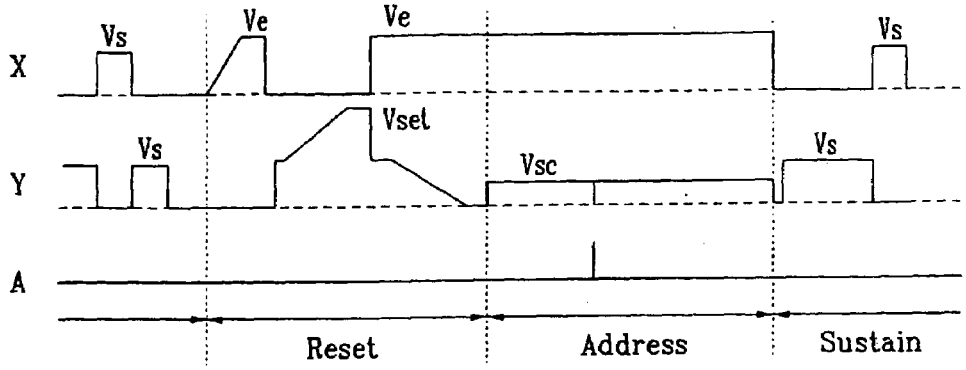
FIG.3 PRIOR ART
FIG. 3 is a drive waveform of a conventional plasma display panel.
Figure 4:
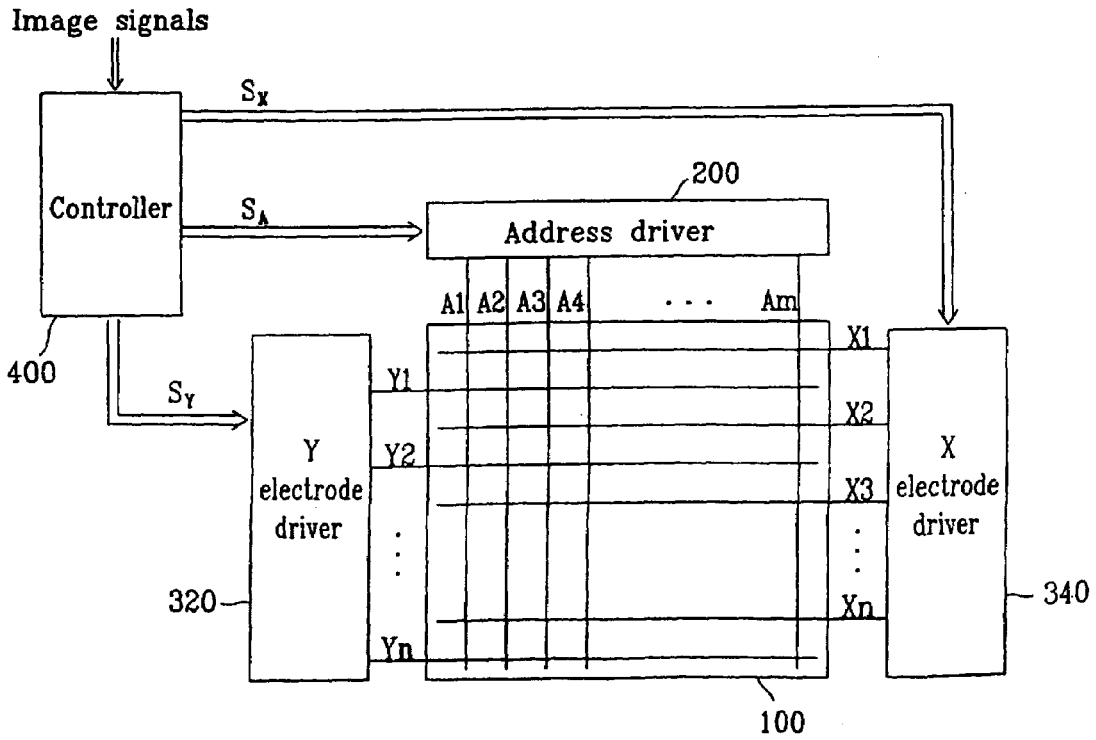
FIG. 4 is a drawing showing a plasma display panel according to a preferred embodiment of the present invention.

FIG. 4 is a drawing showing a plasma display panel according to a preferred embodiment of the present invention.

With reference to FIG. 4, a plasma display panel (PDP) according to a preferred embodiment of the present invention includes a plasma panel 100, an address driver 200, a Y electrode driver 320, an X electrode driver 340, and a controller 400. The plasma panel 100 includes a plurality of address electrodes (A1–Am) that are arranged in a column direction, and scan electrodes (Y electrodes) (Y1–Yn) and common electrodes (X electrodes) (X1–Xn) arranged alternately in a row direction.

The address driver 200 receives address drive control signals SA from the controller 400, and applies display data signals to each of the address electrodes to select discharge cells that will perform display. The Y electrode driver 320 and the X electrode driver 340 receive from the controller 400 Y electrode drive signals SY and X electrode drive signals SX, respectively, for application of the same respectively to the X electrodes and the Y electrodes.

The controller 400 receives external image signals and generates the address drive signals SA, the Y electrode drive signals SY, and the X electrode drive signals SX. The controller 400 then transmits these signals to the address driver 200, the Y electrode driver 320, and the X electrode driver 340.

Figure 5:
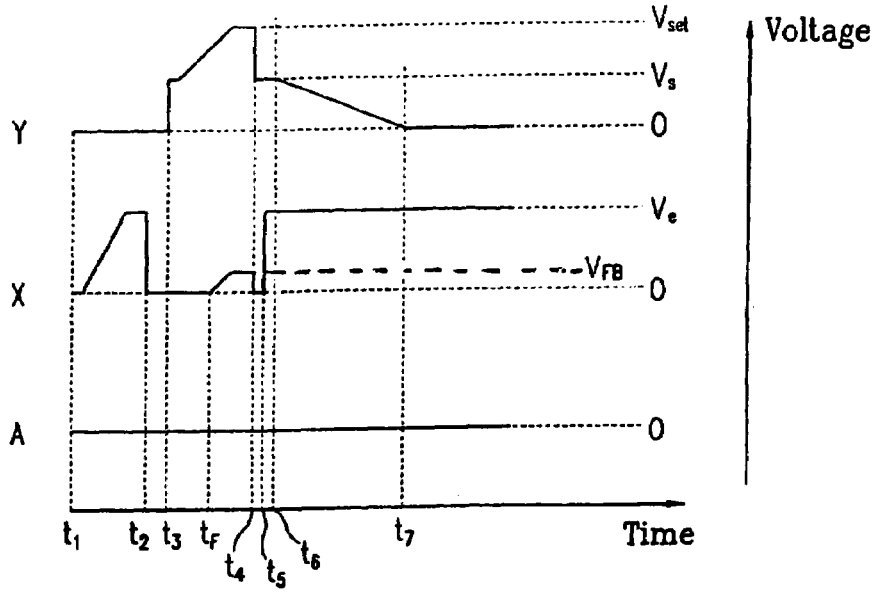
FIG. 5 is a drive waveform of a plasma display panel according to a first preferred embodiment of the present invention.

FIG. 5 is a drive waveform of a plasma display panel according to a first preferred embodiment of the present invention. In the drawing, X, Y, and A indicate voltage waveforms of voltages applied to the X electrodes, the Y electrodes, and the address electrodes, respectively.

Operations in a reset interval according to the first preferred embodiment of the present invention will now be described in detail with reference to FIG. 5.

(1) Elimination Interval (t1–t2)

A voltage applied to the X electrodes is steadily increased from 0V to a first voltage Ve (for example, 190V). Also, 0V are applied to the Y electrodes (Y1, . . . , Yn) and the address electrodes (A1, . . . , Am). Accordingly, a weak discharge occurs between the X electrodes and Y electrodes, and between the X electrodes and address electrodes, and a negative wall charge is formed in the peripheries of the X electrodes.

(2) Y Ramp Ascending Interval (t3–t4)

A voltage applied to the Y electrodes is steadily increased from a voltage Vs, which is slightly lower than the voltage Ve (for example, 180V), to a voltage Vset, which is significantly higher than the voltage Ve (for example, 400V). 0V are applied to the address electrodes during this time.

Also, during an interval from a specific point of the Y ramp ascending interval to an end of the Y ramp ascending interval (tF–t4), a voltage is applied to the X electrodes that steadily increases to a voltage VFB. Optimal values for the interval (tF–t4) and the voltage VFB may be established through repeated experimentation. This increasing voltage may be directly received from the X electrode driver 340. However, as will be described hereinafter, all outputs of the X electrode driver 340 come to be in an electrically floating state (i.e., high impedance state) such that the same effect is obtained.

(3) Y Ramp Descending Interval (t5–t7)

The X electrodes (X1, . . . , Xn) are maintained at the voltage Ve, and the voltage applied to the Y electrodes steadily decreases from the voltage Vs to 0V. Further, 0V are applied to the address electrodes.

In such a drive waveform of the first preferred embodiment of the present invention, with the application of an increasing voltage to the X electrodes in a latter-half portion (tF–t4) of the Y ramp ascending interval, an important advantage is realized. That is, in the Y ramp ascending interval (t3–t4), a voltage smaller than that of the prior art is applied between the Y electrodes and the X electrodes such that an unnecessarily strong discharge generated between the Y electrodes and the X electrodes is reduced, thereby improving contrast of the PDP.

Figure 6:
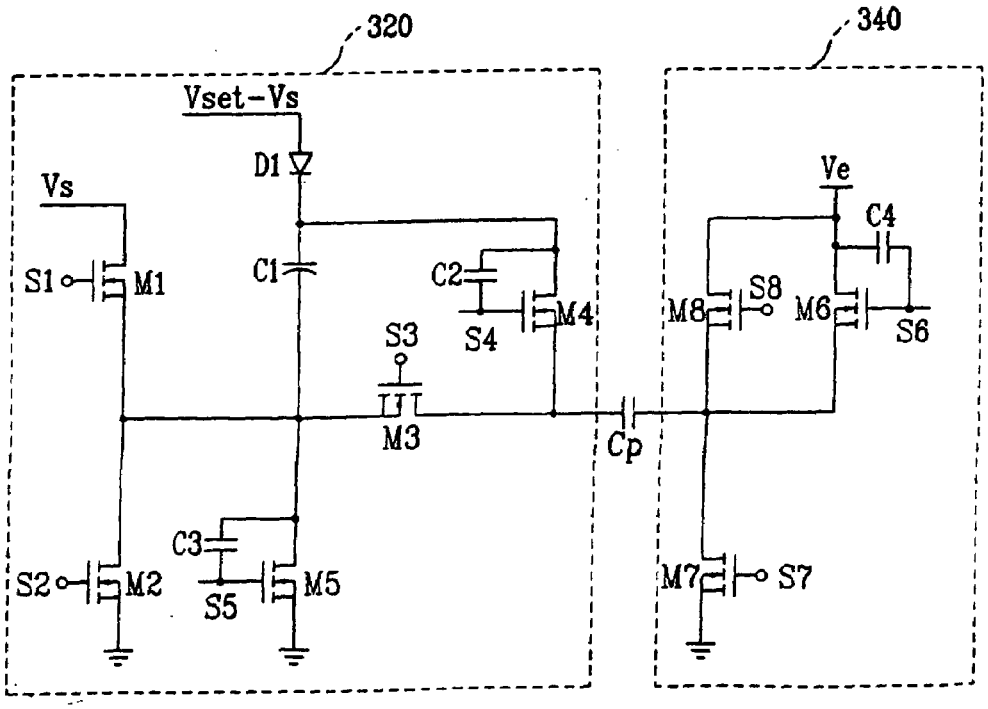
FIG. 6 is a drawing showing an example of a circuit diagram used in applying the drive waveform of FIG. 5.
Figure 7:
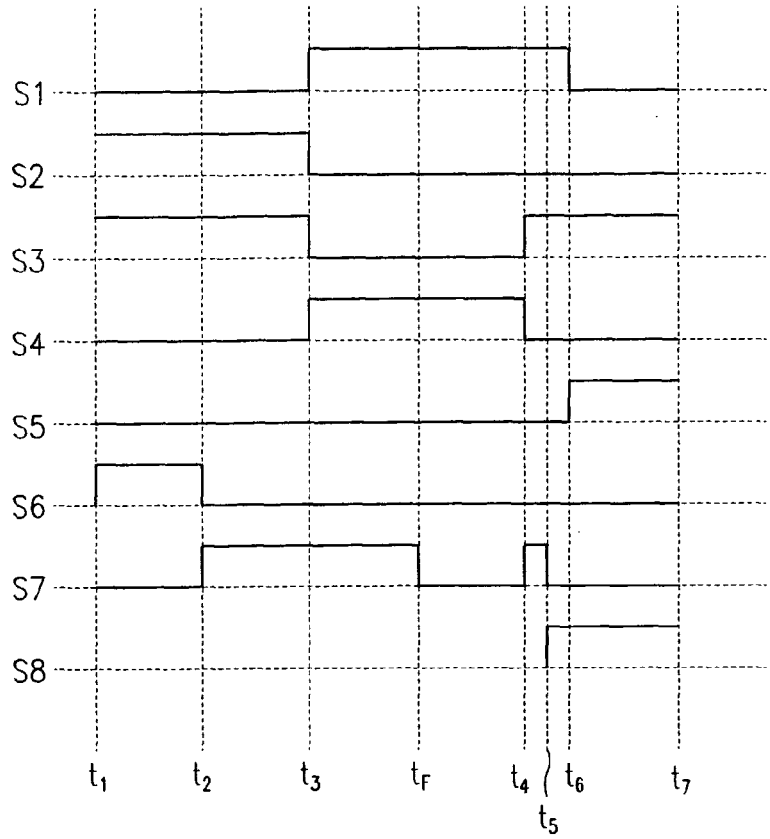
FIG. 7 is a switching timing diagram of the circuit shown in FIG. 6.

FIG. 6 is a detailed circuit diagram of the Y electrode driver 320 and the X electrode driver 340 according to the first preferred embodiment of the present invention, and FIG. 7 is a switching timing diagram of the circuit shown in FIG. 6.

In the Y electrode driver 320 of the first preferred embodiment of the present invention, transistors M1 and M2 are coupled in series between the voltage (Vs), which is a sustain discharge voltage, and the ground voltage. Also, a transistor M3 is coupled to a common node between the transistors M1 and M2 and to a first terminal of a panel capacitor Cp (i.e., Y electrodes) (the panel capacitor exhibits an equivalent capacitance between the X electrodes and the Y electrodes). A first terminal of a capacitor C1 is coupled to the common node between the transistors M1 and M2, and a diode D1 is coupled between a voltage Vset-Vs and a second terminal of the capacitor C1.

In addition, a transistor M4 is provided between the first terminal of the panel capacitor Cp and the capacitor C1 to apply the ascending ramp voltage to the Y electrodes, and a transistor M5 is provided between the first terminal of the panel capacitor C1 and the ground voltage to apply the descending ramp voltage to the Y electrodes. To supply a constant current between sources and drains of the transistors M4 and M5, capacitors C2 and C3 are provided between the drain and gate of the transistor M4 and the drain and gate of the transistor M5, respectively.

With respect to the X electrode driver 340 of the first preferred embodiment of the present invention, a transistor M8 is provided between the voltage Ve and a second terminal of the panel capacitor Cp (i.e., X electrodes), and a transistor M7 is provided between the second terminal of the panel capacitor Cp and ground. The transistor M7 is floated between the second terminal of the panel capacitor Cp and ground to create a high impedance, thereby realizing the application of an increasing voltage to the X electrodes in the Y ramp ascending interval as described with reference to FIG. 5.

Further, a transistor M6 is provided between the voltage Ve and the second terminal of the panel capacitor Cp to apply an elimination waveform to the X electrodes. A capacitor C4 is provided between a drain and a gate of the transistor M6 so that a constant current flows between a source and the drain of the transistor M6.

A drive method according to a first preferred embodiment of the present invention will now be described with reference to FIGS. 5, 6, and 7.

It is assumed that the voltage Vset-Vs is charged in the capacitor C1. Such charging is easily realized by controlling the transistor M2 or the transistor M5 to On. At t=t1 in FIG. 7, the transistor M6 is controlled On in a state where the transistors M2 and M3 are On. Accordingly, since a constant current is supplied to the second terminal of the panel capacitor Cp (X electrodes), an elimination ramp voltage that increases from 0V to the voltage Ve is applied to the X electrodes as shown in FIG. 5.

Next, at t=t2, the transistor M6 is controlled to Off and the transistor M7 is controlled to On. As a result, the voltage of the second terminal of the panel capacitor Cp (X electrodes) becomes 0V.

At t=t3, in a state where the transistor M7 is On, the transistors M2 and M3 are controlled to Off and the transistors M1 and M4 are controlled to On. Therefore, the voltage Vs is supplied to the first terminal of the capacitor C1, and because the voltage Vset-Vs is already charged in the capacitor C1, the voltage of the second terminal of the capacitor C1 becomes Vset. Further, the voltage Vset of the second terminal of the capacitor C1 is supplied to the first terminal of the panel capacitor (Y electrodes) through the transistor M4. At this time, since a constant current flows between the source and drain of the transistor M4 by the influence of the capacitor C2, a voltage that increases from the voltage Vs to the voltage Vset is applied to the first terminal of the capacitor Cp (Y electrodes).

In addition, the transistor M7 is controlled to Off at a specific point (t=tF) of the interval (t3–t4) when the voltage of the first terminal of the panel capacitor Cp (Y electrodes) increases from the voltage Vs to the voltage Vset. Accordingly, the second terminal of the panel capacitor Cp (X electrodes) that is maintained at 0V changes to a floating state such that the voltage of the second terminal of the panel capacitor Cp (X electrodes) (hereinafter referred to as a floating voltage") varies in accordance with the voltage of the first terminal (Y electrodes) as shown in FIG. 5.

In more detail, the voltage of the second terminal of the panel capacitor Cp (X electrodes) corresponds to a value of subtracting the voltage charged in the panel capacitor Cp from the voltage of the Y electrodes such that the voltage of the X electrodes increases from 0V to the voltage VFB and following the same increasing pattern of the voltage of the Y electrodes increases. At this time, the floating voltage VFB is determined according to the interval of floating the second terminal of the panel capacitor Cp (X electrodes) (i.e., the interval when the transistor M7 is controlled to Off). Hence, the greater the floating interval, the higher the floating voltage VFB. Therefore, in the preferred embodiment of the present invention, determining the optimal floating voltage VFB through repeated experimentation is, in effect, determining the point at which the transistor M7 is controlled to Off.

At t=t4, the transistors M3 and M7 are controlled to On, and the transistor M4 is controlled to Off. Accordingly, the voltage Vs is applied to the Y electrodes, and the ground voltage is applied to the X electrodes. At t=t5, the transistor M7 is controlled to Off, the transistor M8 is controlled to On, and the voltage Ve is applied to the X electrodes. At t=t6, in a state where the transistor M3 is controlled to On, the transistor M1 is controlled to Off and the transistor M5 is controlled to On. As a result, the voltage of the first terminal of the panel capacitor Cp (Y electrodes) decreases from the voltage Vs to the ground voltage.

In the reset drive method of the first preferred embodiment of the present invention described above, during a portion of the Y ramp ascending interval (t3–t4), the X electrodes are floated and a corresponding floating voltage is applied to the X electrodes thereby reducing a difference in voltages applied to the X electrodes and the Y electrodes. Therefore, the contrast of the PDP is improved.

However, with the drive method of the first preferred embodiment of the present invention, reset is unreliable so that a subsequent addressing operation without flaws cannot be obtained. Accordingly, the following problems result if, in order to improve contrast, floating voltages of the same magnitude are applied to the X electrodes with respect to all the sub-fields.

In particular, if the X electrodes are driven by floating the same as in the first preferred embodiment of the present invention, reset is unstable such that discharge occurs in pixels where discharge should not occur during a subsequent sustain discharge interval. Such mis-discharge caused by unstable reset is a significantly greater problem in high gray sub-fields (sub-fields where there are many sustain discharge pulses) than in low gray sub-fields (sub-fields where there are few sustain discharge pulses).

In second and third preferred embodiments of the present invention, the difference in voltages between the X electrodes and Y electrodes is differently set according to sub-field to thereby improve contrast and reduce mis-discharge.

Figure 8:
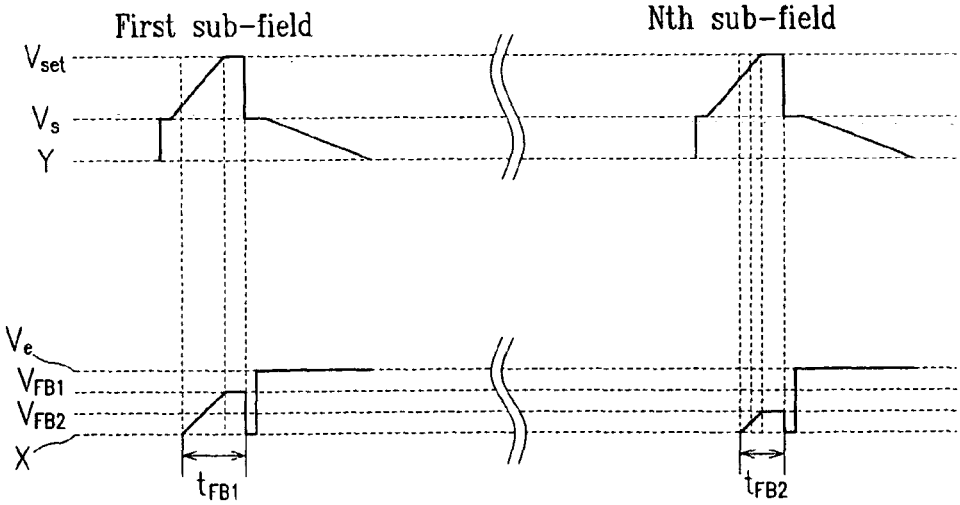
FIG. 8 is a drive waveform of a plasma display panel according to a second preferred embodiment of the present invention.

FIG. 8 is a drive waveform of a plasma display panel according to a second preferred embodiment of the present invention.

As shown in the drawing, in a drive method according to the second preferred embodiment of the present invention, a floating voltage VFB1 of the X electrodes applied during the reset interval of a low gray sub-field (a first sub-field) is greater than a floating voltage VFB2 applied during the reset interval of a high gray sub-field (an nth sub-field). In the FIG. 8, a first sub-field and an nth sub-field are represented as examples of low gray sub-field and high gray sub-field, respectively.

Therefore, the floating voltage VFB1 of the X electrodes is established at a high level (i.e., a low voltage difference between the Y electrodes and the X electrodes) during the reset interval of the low gray sub-field during which a relatively minimal influence of mis-discharge is received such that discharge during the reset interval is reduced. The result of this is that contrast is increased. Further, during the reset interval of the high gray sub-field (the sub-field where there are many sustain discharge pulses) during which the affect of mis-discharge is significant, the floating voltage VFB2 of the X electrodes is established at a low level (i.e., a high voltage difference between the Y electrodes and the X electrodes) to thereby enable reliable reset. This prevents mis-discharge during a subsequent sustain discharge interval.

The drive method according to the second preferred embodiment of the present invention, the drive waveform for which is shown in FIG. 8, may be realized using the drive circuit of FIG. 6.

In more detail, an interval tFB1 that floats the transistor M7 during the reset interval of the low gray sub-field is longer than an interval tFB2 that floats the transistor during the reset interval of the high gray sub-field. Therefore, the floating voltage VFB1 applied to the X electrodes is higher than the floating voltage VFB2 applied to the X electrodes of the reset interval of the high gray sub-field.

Figure 9:
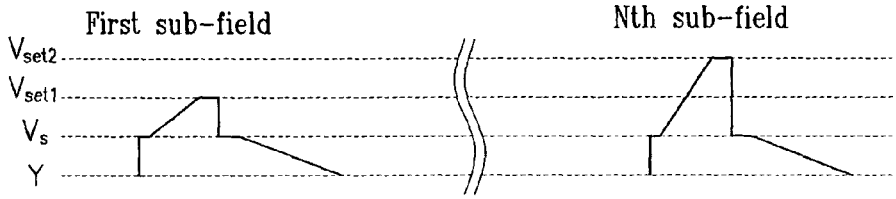
FIG. 9 is a drive waveform of a plasma display panel according to a third preferred embodiment of the present invention.

FIG. 9 is a drive waveform of a plasma display panel according to a third preferred embodiment of the present invention.

As shown in the drawing, in a drive method according to the third preferred embodiment of the present invention, a voltage Vset1 of the Y electrodes applied during a reset interval of a first sub-field (low gray sub-field) is less than a voltage Vset2 of the Y electrodes applied during a reset interval of an nth sub-field (high gray sub-field). As a result, the voltage of the Y electrodes is established at a low level (i.e., a low voltage difference between the Y electrodes and the X electrodes) during the reset interval of the low gray sub-field during which a relatively minimal influence of mis-discharge is received such that discharge during the reset interval is reduced. The result of this is that contrast is improved. Further, during the reset interval of the high gray sub-field during which the affect of mis-discharge is significant, the voltage of the Y electrodes is established at a high level (i.e., a high voltage difference between the Y electrodes and the X electrodes) to thereby enable reliable reset. This prevents mis-discharge during a subsequent sustain discharge interval.

Figure 10:
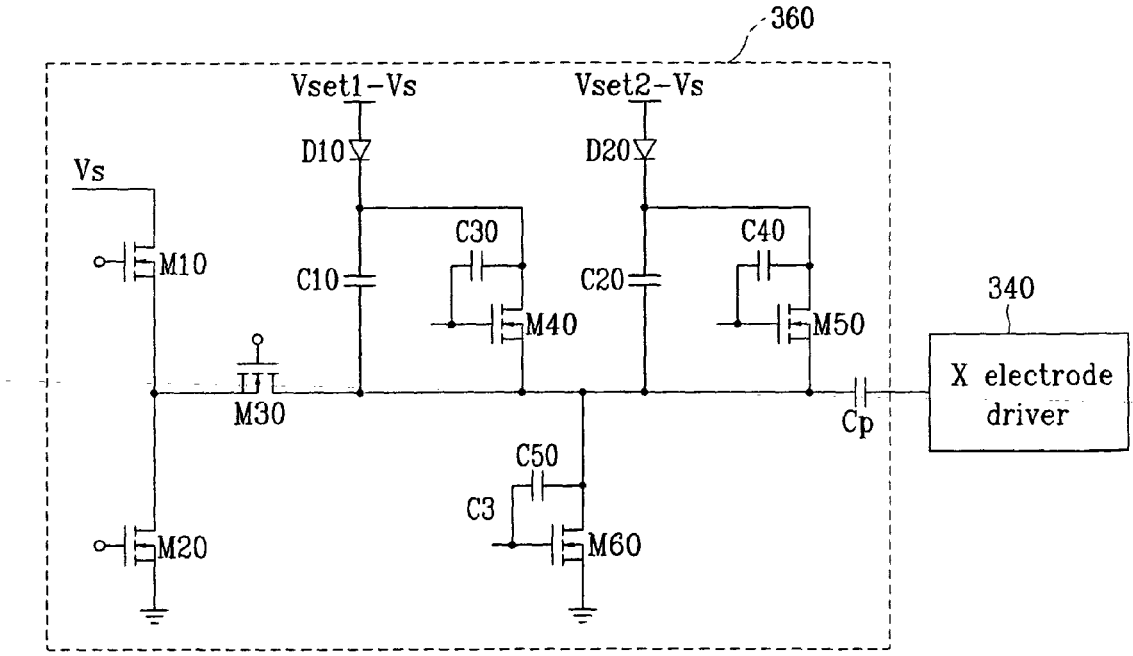
FIG. 10 is a drawing showing an example of a circuit diagram used in applying the drive waveform of FIG. 9.

FIG. 10 is a drawing showing an example of a circuit diagram used in applying the drive waveform of FIG. 9.

A drive circuit of FIG. 10 is almost identical to the drive circuit of FIG. 6. However, voltage sources and circuit elements for applying a Y ramp increasing voltage are different. In more detail, in order to apply a Y ascending ramp voltage during a first sub-field, a voltage source Vset1-Vs, a diode D10, capacitors C10 and C30, and a transistor M40 are provided. Also, in order to apply a Y ascending ramp voltage of an nth sub-field, there are provided a voltage source Vset2-Vs, a diode D20, capacitors C20 and C40, and a transistor M50.

In the drive circuit shown in FIG. 10, the transistor M40 is controlled to On in the first sub-field such that a voltage of the Y electrodes is increased from the voltage Vs to the voltage Vset1, and the transistor M50 is controlled to On in the nth sub-field such that the voltage of the Y electrodes is increased from the voltage Vs to the voltage Vset2. Other operations of the circuit of FIG. 10 may be easily determined by those skilled in the art from the description provided with respect to the circuit shown in FIG. 6. An explanation will therefore not be provided herein.

As described above, during a portion of the reset interval, the X electrodes are floated such that discharge is reduced, thereby increasing the contrast of the PDP. Further, the differences in the voltage for the Y electrodes and that for the X electrodes are differently set depending on the sub-field such that contrast is reduced and mis-discharge in the high gray sub-fields is prevented.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A drive method for improving contrast of a plasma display panel having a first electrode, a second electrode, and a panel capacitor formed between the first electrode and the second electrode, with a driving field of the plasma display panel being divided into a plurality of sub-fields each sub-field including a reset interval, an address interval, and a sustain discharge interval, the method comprising:

during a reset interval of a first sub-field, applying a first set of predetermined voltages to the first electrode and to the second electrode to develop a first discharge voltage between the first electrode and the second electrode; and during a reset interval of a second sub-field, in response to the second sub-field exhibiting a higher gray than the first sub-field, applying a second set of predetermined voltages to the first electrode and to the second electrode to develop a second discharge voltage between the first electrode and the second electrode, the second discharge voltage being greater than the first discharge voltage.

2. The drive method of claim 1, wherein applying a first set of predetermined voltages during a reset interval of a first sub-field comprises:

applying a first electrode increasing voltage waveform to the first electrode during a first interval of the reset interval of the first sub-field;

applying a second electrode increasing voltage waveform to the second electrode during a portion of the first interval of the reset interval of the first sub-field; and wherein applying a second set of predetermined voltages during a reset interval of a second sub-field comprises:

applying a first electrode increasing voltage waveform to the first electrode during a first interval of the reset interval of the second sub-field; and applying a second electrode increasing voltage waveform to the second electrode during a portion of the first interval of the reset interval of the second sub-field, wherein a maximum voltage of the second electrode increasing voltage waveform in the second sub-field is less than a maximum voltage of the second electrode increasing voltage waveform applied in the first sub-field.

3. The method of claim 2, wherein applying a second electrode increasing voltage waveform in the first sub-field and in the second sub-field is realized by floating the second electrode such that a second sub-field voltage discharge is greater than a first sub-field voltage discharge.

4. The method of claim 3, wherein an interval during which the second electrode is floated during the first interval is longer than an interval during which the second electrode is floated during the second interval.

5. The method of claim 1, wherein applying the first set of predetermined voltages to the first electrode and to the second electrode comprises applying to the first electrode a first first electrode increasing voltage waveform while maintaining the second electrode at approximately ground voltage, and wherein applying the second set of predetermined voltages to the first electrode and to the second electrode comprises applying to the first electrode a second first electrode increasing voltage waveform while maintaining the second electrode at approximately ground voltage, wherein a maximum voltage of the second first electrode increasing voltage waveform is greater than a maximum voltage of the first first electrode increasing voltage waveform.

6. A drive method for improving contrast of a plasma display panel having a scan electrode, a common electrode, and a panel capacitor formed between the scan electrode and the common electrode, with a driving field of the plasma display panel being divided into a plurality of sub-fields, each sub-field including a reset interval, an address interval, and a sustain discharge interval, the method comprising:

in a reset interval of a first sub-field:

applying an increasing voltage waveform to the scan electrode during a first interval; and floating the common electrode during a portion of the first interval to generate a first sub-field discharge voltage; and in a reset interval of a second sub-field, in response to the second sub-field exhibiting a higher gray than the first sub-field:

applying an increasing voltage waveform to the scan electrode during a second interval; and floating the common electrode during a portion of the second interval to generate a second sub-field discharge voltage, wherein the second sub-field discharge is greater than the first sub-field discharge voltage.

7. The drive method of claim 6, further comprising:

during a second interval of the reset interval of the first sub-field, applying to the scan electrode a voltage having a decreasing ramp waveform; and during a second interval of the reset interval of the second sub-field, applying to the scan electrode a voltage having a decreasing ramp waveform.

8. The drive method of claim 6, wherein the portion of the first interval is longer than the portion of the second interval.

9. A drive apparatus for improving contrast of a plasma display panel having a scan electrode, a common electrode, and a panel capacitor provided between the scan electrode and the common electrode, with a driving field of the plasma display panel being divided into a plurality of sub-fields, each sub-field including a reset interval, an address interval and a sustain discharge interval, the apparatus comprising:

a first transistor coupled to the scan electrode, the first transistor applying to the scan electrode a first increasing voltage waveform during a first interval of a reset interval of a first sub-field to develop a first sub-field discharge voltage;

a second transistor coupled to the scan electrode, the second transistor, in response to a second sub-field exhibiting a higher gray than the first sub-field, applying to the scan electrode a second increasing voltage waveform during a first interval of a reset interval of a second sub-field to develop a second sub-field discharge voltage that is greater than the first sub-field discharge voltage; and a third transistor coupled between a ground voltage and the scan electrode, the third transistor applying to the scan electrode a decreasing voltage waveform during a second interval of a reset interval of the first sub-field and during a second interval of a reset interval of the second sub-field.

10. The drive apparatus of claim 9, further comprising a fourth transistor coupled to the common electrode and applying an increasing voltage waveform to the common electrode.

11. An electrode driving method for preventing unnecessary discharge for a plasma display panel having a scan electrode and a common electrode, the method comprising:

during a reset interval of a first sub-field:

during a first interval of the reset interval, the first interval being subsequent to an elimination voltage being applied to the common electrode:

maintaining the common electrode at a ground voltage during an initial interval of the first interval while applying to the scan electrode a scan electrode increasing voltage waveform from a voltage lower than a maximum voltage of the elimination voltage to a voltage higher than the maximum voltage of the elimination voltage; and during a portion of the first interval that is subsequent to the initial interval:

applying to the common electrode a common electrode increasing voltage waveform to reduce a discharge voltage between the scan electrode and the common electrode, wherein the common electrode increasing voltage waveform is applied while the scan electrode voltage increasing waveform is being applied.

12. The electrode driving method of claim 11, further comprising:

during a reset interval of a second sub-field:

applying to the common electrode a second common electrode increasing voltage waveform, wherein, in response to the second sub-field having a greater number of sustain discharge pulses than a number of sustain discharge pulses of the first sub-field, a maximum of the applied second common electrode increasing voltage waveform being greater than a maximum of the common electrode increasing voltage waveform applied during the reset interval of the first sub-field.

13. The electrode driving method of claim 11, further comprising:

during a reset interval of a second sub-field:

applying to the scan electrode a second scan electrode increasing voltage waveform, wherein, in response to the second sub-field having a greater number of sustain discharge pulses than a number of sustain discharge pulses of the first sub-field, a maximum of the applied second scan electrode increasing voltage waveform being greater than a maximum of the scan electrode increasing voltage waveform applied during the reset interval of the first sub-field.

* * * * *